US008761344B2

(12) United States Patent
Reynolds et al.

(10) Patent No.: US 8,761,344 B2
(45) Date of Patent: Jun. 24, 2014

(54) SMALL X-RAY TUBE WITH ELECTRON BEAM CONTROL OPTICS

(75) Inventors: David Reynolds, Orem, UT (US); Eric J. Miller, Provo, UT (US); Sterling W. Cornaby, Springville, UT (US); Derek Hullinger, Orem, UT (US); Charles R. Jensen, American Fork, UT (US)

(73) Assignee: Moxtek, Inc., Orem, UT (US)

( * ) Notice: Subject to any disclaimer, the term of this patent is extended or adjusted under 35 U.S.C. 154(b) by 412 days.

(21) Appl. No.: 13/340,067

(22) Filed: Dec. 29, 2011

(65) Prior Publication Data

US 2013/0170623 A1 Jul. 4, 2013

(51) Int. Cl.
*H01J 35/06* (2006.01)
*H01J 35/14* (2006.01)

(52) U.S. Cl.
USPC ..... 378/138; 378/136

(58) Field of Classification Search
CPC ..... H01J 35/06; H01J 35/14; H05G 1/02; H05G 1/52
USPC ..... 378/119, 121, 136, 138
See application file for complete search history.

(56) References Cited

U.S. PATENT DOCUMENTS

| | | | |
|---|---|---|---|
| 1,881,448 | A | 10/1932 | Forde et al. |
| 1,946,288 | A | 2/1934 | Kearsley |
| 2,291,948 | A | 8/1942 | Cassen |
| 2,316,214 | A | 4/1943 | Atlee |
| 2,329,318 | A | 9/1943 | Atlee et al. |
| 2,340,363 | A | 2/1944 | Atlee et al. |
| 2,502,070 | A | 3/1950 | Atlee et al. |
| 2,663,812 | A | 3/1950 | Jamison et al. |
| 2,683,223 | A | 7/1954 | Hosemann |
| 2,952,790 | A | 9/1960 | Steen |
| 3,356,559 | A | 12/1967 | Mohn et al. |
| 3,397,337 | A | 8/1968 | Denholm |
| 3,434,062 | A | 3/1969 | Cox |
| 3,665,236 | A | 5/1972 | Gaines et al. |
| 3,679,927 | A | 7/1972 | Kirkendall |
| 3,691,417 | A | 9/1972 | Gralenski |
| 3,741,797 | A | 6/1973 | Chavasse, Jr. et al. |
| 3,751,701 | A | 8/1973 | Gralenski et al. |
| 3,801,847 | A | 4/1974 | Dietz |

(Continued)

FOREIGN PATENT DOCUMENTS

| | | |
|---|---|---|
| DE | 1030936 | 5/1958 |
| DE | 4430623 | 3/1996 |

(Continued)

OTHER PUBLICATIONS

U.S. Appl. No. 12/899,750, filed Oct. 7, 2010; Steven Liddiard; notice of allowance dated Jun. 4, 2013.

(Continued)

*Primary Examiner* — Anastasia Midkiff
(74) *Attorney, Agent, or Firm* — Thorpe North & Western LLP

(57) ABSTRACT

An x-ray tube comprising an anode and a cathode disposed at opposing ends of an electrically insulative cylinder. The x-ray tube includes an operating range of 15 kilovolts to 40 kilovolts between the cathode and the anode. The x-ray tube has an overall diameter, defined as a largest diameter of the x-ray tube anode, cathode, and insulative cylinder, of less than 0.6 inches. A direct line of sight exists between all points on an electron emitter at the cathode to a target at the anode.

20 Claims, 2 Drawing Sheets

(56) References Cited

U.S. PATENT DOCUMENTS

| | | | |
|---|---|---|---|
| 3,828,190 | A | 8/1974 | Dahlin et al. |
| 3,851,266 | A | 11/1974 | Conway |
| 3,872,287 | A | 3/1975 | Kooman |
| 3,882,339 | A | 5/1975 | Rate et al. |
| 3,894,219 | A | 7/1975 | Weigel |
| 3,962,583 | A | 6/1976 | Holland et al. |
| 3,970,884 | A | 7/1976 | Golden |
| 4,007,375 | A | 2/1977 | Albert |
| 4,075,526 | A | 2/1978 | Grubis |
| 4,160,311 | A | 7/1979 | Ronde et al. |
| 4,163,900 | A | 8/1979 | Warren et al. |
| 4,178,509 | A | 12/1979 | More et al. |
| 4,184,097 | A | 1/1980 | Auge |
| 4,250,127 | A | 2/1981 | Warren et al. |
| 4,293,373 | A | 10/1981 | Greenwood |
| 4,368,538 | A | 1/1983 | McCorkle |
| 4,393,127 | A | 7/1983 | Greschner et al. |
| 4,400,822 | A | 8/1983 | Kuhnke et al. |
| 4,421,986 | A | 12/1983 | Friauf et al. |
| 4,443,293 | A | 4/1984 | Mallon et al. |
| 4,463,338 | A | 7/1984 | Utner et al. |
| 4,504,895 | A | 3/1985 | Steigerwald |
| 4,521,902 | A | 6/1985 | Peugeot |
| 4,532,150 | A | 7/1985 | Endo et al. |
| 4,573,186 | A | 2/1986 | Reinhold |
| 4,576,679 | A | 3/1986 | White |
| 4,591,756 | A | 5/1986 | Avnery |
| 4,608,326 | A | 8/1986 | Neukermans et al. |
| 4,675,525 | A | 6/1987 | Amingual et al. |
| 4,679,219 | A | 7/1987 | Ozaki |
| 4,688,241 | A | 8/1987 | Peugeot |
| 4,705,540 | A | 11/1987 | Hayes |
| 4,734,924 | A | 3/1988 | Yahata et al. |
| 4,761,804 | A | 8/1988 | Yahata |
| 4,777,642 | A | 10/1988 | Ono |
| 4,797,907 | A | 1/1989 | Anderton |
| 4,818,806 | A | 4/1989 | Kunimune et al. |
| 4,819,260 | A | 4/1989 | Haberrecker |
| 4,862,490 | A | 8/1989 | Karnezos et al. |
| 4,870,671 | A | 9/1989 | Hershyn |
| 4,876,330 | A | 10/1989 | Higashi et al. |
| 4,878,866 | A | 11/1989 | Mori et al. |
| 4,885,055 | A | 12/1989 | Woodbury et al. |
| 4,891,831 | A | 1/1990 | Tanaka et al. |
| 4,933,557 | A | 6/1990 | Perkins |
| 4,939,763 | A | 7/1990 | Pinneo et al. |
| 4,957,773 | A | 9/1990 | Spencer et al. |
| 4,960,486 | A | 10/1990 | Perkins et al. |
| 4,969,173 | A | 11/1990 | Valkonet |
| 4,979,198 | A | 12/1990 | Malcolm et al. |
| 4,979,199 | A | 12/1990 | Cueman et al. |
| 4,995,069 | A | 2/1991 | Tanaka |
| 5,010,562 | A | 4/1991 | Hernandez et al. |
| 5,063,324 | A | 11/1991 | Grunwald et al. |
| 5,066,300 | A | 11/1991 | Isaacson et al. |
| 5,077,771 | A | 12/1991 | Skillicorn et al. |
| 5,077,777 | A | 12/1991 | Daly |
| 5,090,046 | A | 2/1992 | Friel |
| 5,105,456 | A | 4/1992 | Rand et al. |
| 5,117,829 | A | 6/1992 | Miller et al. |
| 5,153,900 | A | 10/1992 | Nomikos et al. |
| 5,161,179 | A | 11/1992 | Suzuki et al. |
| 5,173,612 | A | 12/1992 | Imai et al. |
| 5,178,140 | A | 1/1993 | Ibrahim |
| 5,187,737 | A | 2/1993 | Watanabe |
| 5,196,283 | A | 3/1993 | Ikeda et al. |
| 5,200,984 | A | 4/1993 | Laeuffer |
| 5,217,817 | A | 6/1993 | Verspui et al. |
| 5,226,067 | A | 7/1993 | Allred et al. |
| RE34,421 | E | 10/1993 | Parker et al. |
| 5,258,091 | A | 11/1993 | Imai et al. |
| 5,267,294 | A | 11/1993 | Kuroda et al. |
| 5,343,112 | A | 8/1994 | Wegmann |
| 5,347,571 | A | 9/1994 | Furbee et al. |
| 5,391,958 | A | 2/1995 | Kelly |
| 5,392,042 | A | 2/1995 | Pellon |
| 5,400,385 | A | 3/1995 | Blake et al. |
| 5,422,926 | A | 6/1995 | Smith et al. |
| 5,428,658 | A | 6/1995 | Oettinger et al. |
| 5,432,003 | A | 7/1995 | Plano et al. |
| 5,469,429 | A | 11/1995 | Yamazaki et al. |
| 5,469,490 | A | 11/1995 | Golden et al. |
| 5,478,266 | A | 12/1995 | Kelly |
| 5,521,851 | A | 5/1996 | Wei et al. |
| 5,524,133 | A | 6/1996 | Neale et al. |
| RE35,383 | E | 11/1996 | Miller et al. |
| 5,571,616 | A | 11/1996 | Phillips et al. |
| 5,578,360 | A | 11/1996 | Viitanen |
| 5,607,723 | A | 3/1997 | Plano et al. |
| 5,621,780 | A | 4/1997 | Smith et al. |
| 5,627,871 | A | 5/1997 | Wang |
| 5,631,943 | A | 5/1997 | Miles |
| 5,673,044 | A | 9/1997 | Pellon |
| 5,680,433 | A | 10/1997 | Jensen |
| 5,682,412 | A | 10/1997 | Skillicorn et al. |
| 5,696,808 | A | 12/1997 | Lenz |
| 5,706,354 | A | 1/1998 | Stroehlein |
| 5,729,583 | A | 3/1998 | Tang et al. |
| 5,774,522 | A | 6/1998 | Warburton |
| 5,812,632 | A | 9/1998 | Schardt et al. |
| 5,835,561 | A | 11/1998 | Moorman et al. |
| 5,870,051 | A | 2/1999 | Warburton |
| 5,898,754 | A | 4/1999 | Gorzen |
| 5,907,595 | A | 5/1999 | Sommerer |
| 5,978,446 | A | 11/1999 | Resnick |
| 6,002,202 | A | 12/1999 | Meyer et al. |
| 6,005,918 | A | 12/1999 | Harris et al. |
| 6,044,130 | A | 3/2000 | Inazura et al. |
| 6,062,931 | A | 5/2000 | Chuang et al. |
| 6,069,278 | A | 5/2000 | Chuang |
| 6,073,484 | A | 6/2000 | Miller et al. |
| 6,075,839 | A | 6/2000 | Treseder |
| 6,097,790 | A | 8/2000 | Hasegawa et al. |
| 6,129,901 | A | 10/2000 | Moskovits et al. |
| 6,133,401 | A | 10/2000 | Jensen |
| 6,134,300 | A | 10/2000 | Trebes et al. |
| 6,184,333 | B1 | 2/2001 | Gray |
| 6,205,200 | B1 | 3/2001 | Boyer et al. |
| 6,277,318 | B1 | 8/2001 | Bower et al. |
| 6,282,263 | B1 | 8/2001 | Arndt et al. |
| 6,288,209 | B1 | 9/2001 | Jensen |
| 6,307,008 | B1 | 10/2001 | Lee et al. |
| 6,320,019 | B1 | 11/2001 | Lee et al. |
| 6,351,520 | B1 | 2/2002 | Inazaru |
| 6,385,294 | B2 | 5/2002 | Suzuki et al. |
| 6,388,359 | B1 | 5/2002 | Duelli et al. |
| 6,438,207 | B1 | 8/2002 | Chidester et al. |
| 6,477,235 | B2 | 11/2002 | Chornenky et al. |
| 6,487,272 | B1 | 11/2002 | Kutsuzawa |
| 6,487,273 | B1 | 11/2002 | Takenaka et al. |
| 6,494,618 | B1 | 12/2002 | Moulton |
| 6,546,077 | B2 | 4/2003 | Chornenky et al. |
| 6,567,500 | B2 | 5/2003 | Rother |
| 6,645,757 | B1 | 11/2003 | Okandan et al. |
| 6,646,366 | B2 | 11/2003 | Hell et al. |
| 6,658,085 | B2 | 12/2003 | Sklebitz et al. |
| 6,661,876 | B2 | 12/2003 | Turner et al. |
| 6,740,874 | B2 | 5/2004 | Doring |
| 6,778,633 | B1 | 8/2004 | Loxley et al. |
| 6,799,075 | B1 | 9/2004 | Chornenky et al. |
| 6,803,570 | B1 | 10/2004 | Bryson, III et al. |
| 6,803,571 | B1 | 10/2004 | Mankos et al. |
| 6,816,573 | B2 | 11/2004 | Hirano et al. |
| 6,819,741 | B2 | 11/2004 | Chidester |
| 6,852,365 | B2 | 2/2005 | Smart et al. |
| 6,866,801 | B1 | 3/2005 | Mau et al. |
| 6,876,724 | B2 | 4/2005 | Zhou |
| 6,956,706 | B2 | 10/2005 | Brandon |
| 6,976,953 | B1 | 12/2005 | Pelc |
| 6,987,835 | B2 | 1/2006 | Lovoi |
| 7,035,379 | B2 | 4/2006 | Turner et al. |
| 7,046,767 | B2 | 5/2006 | Okada et al. |
| 7,049,735 | B2 | 5/2006 | Ohkubo et al. |
| 7,050,539 | B2 | 5/2006 | Loef et al. |

(56) References Cited

U.S. PATENT DOCUMENTS

| | | | |
|---|---|---|---|
| 7,075,699 | B2 | 7/2006 | Oldham et al. |
| 7,085,354 | B2 | 8/2006 | Kanagami |
| 7,108,841 | B2 | 9/2006 | Smalley |
| 7,110,498 | B2 | 9/2006 | Yamada |
| 7,130,380 | B2 | 10/2006 | Lovoi et al. |
| 7,130,381 | B2 | 10/2006 | Lovoi et al. |
| 7,203,283 | B1 | 4/2007 | Puusaari |
| 7,206,381 | B2 | 4/2007 | Shimono et al. |
| 7,215,741 | B2 | 5/2007 | Ukita |
| 7,224,769 | B2 | 5/2007 | Turner |
| 7,233,647 | B2 | 6/2007 | Turner et al. |
| 7,286,642 | B2 | 10/2007 | Ishikawa et al. |
| 7,305,066 | B2 | 12/2007 | Ukita |
| 7,317,784 | B2 | 1/2008 | Durst et al. |
| 7,358,593 | B2 | 4/2008 | Smith et al. |
| 7,382,862 | B2 | 6/2008 | Bard et al. |
| 7,399,794 | B2 | 7/2008 | Harmon et al. |
| 7,410,603 | B2 | 8/2008 | Noguchi et al. |
| 7,428,298 | B2 | 9/2008 | Bard et al. |
| 7,448,801 | B2 | 11/2008 | Oettinger et al. |
| 7,448,802 | B2 | 11/2008 | Oettinger et al. |
| 7,486,774 | B2 | 2/2009 | Cain |
| 7,526,068 | B2 | 4/2009 | Dinsmore |
| 7,529,345 | B2 | 5/2009 | Bard et al. |
| 7,618,906 | B2 | 11/2009 | Meilahti |
| 7,634,052 | B2 | 12/2009 | Grodzins et al. |
| 7,649,980 | B2 | 1/2010 | Aoki et al. |
| 7,650,050 | B2 | 1/2010 | Haffner et al. |
| 7,657,002 | B2 | 2/2010 | Burke et al. |
| 7,675,444 | B1 | 3/2010 | Smith et al. |
| 7,680,652 | B2 | 3/2010 | Giesbrecht et al. |
| 7,693,265 | B2 | 4/2010 | Hauttmann et al. |
| 7,709,820 | B2 | 5/2010 | Decker et al. |
| 7,737,424 | B2 | 6/2010 | Xu et al. |
| 7,756,251 | B2 | 7/2010 | Davis et al. |
| 7,983,394 | B2 | 7/2011 | Kozaczek et al. |
| 2002/0075999 | A1 | 6/2002 | Rother |
| 2002/0094064 | A1 | 7/2002 | Zhou |
| 2003/0096104 | A1 | 5/2003 | Tobita et al. |
| 2003/0152700 | A1 | 8/2003 | Asmussen et al. |
| 2003/0165418 | A1 | 9/2003 | Ajayan et al. |
| 2004/0076260 | A1 | 4/2004 | Charles, Jr. et al. |
| 2005/0018817 | A1 | 1/2005 | Oettinger et al. |
| 2005/0141669 | A1 | 6/2005 | Shimono et al. |
| 2005/0207537 | A1 | 9/2005 | Ukita |
| 2006/0073682 | A1 | 4/2006 | Furukawa et al. |
| 2006/0098778 | A1 | 5/2006 | Oettinger et al. |
| 2006/0210020 | A1 | 9/2006 | Takahashi et al. |
| 2006/0233307 | A1 | 10/2006 | Dinsmore |
| 2006/0269048 | A1 | 11/2006 | Cain |
| 2006/0280289 | A1 | 12/2006 | Hanington et al. |
| 2007/0025516 | A1 | 2/2007 | Bard et al. |
| 2007/0111617 | A1 | 5/2007 | Meilahti |
| 2007/0165780 | A1 | 7/2007 | Durst et al. |
| 2007/0172104 | A1 | 7/2007 | Nishide |
| 2007/0183576 | A1 | 8/2007 | Burke et al. |
| 2007/0217574 | A1 | 9/2007 | Beyerlein |
| 2008/0199399 | A1 | 8/2008 | Chen et al. |
| 2008/0296479 | A1 | 12/2008 | Anderson et al. |
| 2008/0296518 | A1 | 12/2008 | Xu et al. |
| 2008/0317982 | A1 | 12/2008 | Hecht |
| 2009/0085426 | A1 | 4/2009 | Davis et al. |
| 2009/0086923 | A1 | 4/2009 | Davis et al. |
| 2009/0213914 | A1 | 8/2009 | Dong et al. |
| 2009/0243028 | A1 | 10/2009 | Dong et al. |
| 2010/0098216 | A1 | 4/2010 | Dobson |
| 2010/0126660 | A1 | 5/2010 | O'Hara |
| 2010/0140497 | A1 | 6/2010 | Damiano, Jr. et al. |
| 2010/0189225 | A1 | 7/2010 | Ernest et al. |
| 2010/0239828 | A1 | 9/2010 | Cornaby et al. |
| 2010/0243895 | A1 | 9/2010 | Xu et al. |
| 2010/0285271 | A1 | 11/2010 | Davis et al. |
| 2011/0121179 | A1 | 5/2011 | Liddiard et al. |
| 2012/0025110 | A1 | 2/2012 | Davis et al. |
| 2012/0076276 | A1 | 3/2012 | Wang et al. |
| 2012/0087476 | A1 | 4/2012 | Liddiard et al. |

FOREIGN PATENT DOCUMENTS

| | | |
|---|---|---|
| DE | 19818057 | 11/1999 |
| EP | 0297808 | 1/1989 |
| EP | 0330456 | 8/1989 |
| EP | 0400655 | 5/1990 |
| EP | 0676772 | 3/1995 |
| GB | 1252290 | 11/1971 |
| JP | 57 082954 | 8/1982 |
| JP | 3170673 | 7/1991 |
| JP | 4171700 | 6/1992 |
| JP | 05066300 | 3/1993 |
| JP | 5135722 | 6/1993 |
| JP | 06119893 | 7/1994 |
| JP | 6289145 | 10/1994 |
| JP | 6343478 | 12/1994 |
| JP | 8315783 | 11/1996 |
| JP | 2003/007237 | 1/2003 |
| JP | 2003/088383 | 3/2003 |
| JP | 2003510236 | 3/2003 |
| JP | 2003211396 | 7/2003 |
| JP | 2006297549 | 11/2006 |
| KR | 1020050107094 | 11/2005 |
| WO | WO 99/65821 | 12/1999 |
| WO | WO 00/17102 | 3/2000 |
| WO | WO 03/076951 | 9/2003 |
| WO | WO 2008/052002 | 5/2008 |
| WO | WO 2009/009610 | 1/2009 |
| WO | WO 2009/045915 | 4/2009 |
| WO | WO 2009/085351 | 7/2009 |
| WO | WO 2010/107600 | 9/2010 |

OTHER PUBLICATIONS

U.S. Appl. No. 12/890,325, filed Sep. 24, 2010; Dongbing Wang; notice of allowance dated Jul. 16, 2013.

Barkan et al., "Improved window for low-energy x-ray transmission a Hybrid design for energy-dispersive microanalysis," Sep. 1995, 2 pages, Ectroscopy 10(7).

Blanquart et al.; "XPAD, a New Read-out Pixel Chip for X-ray Counting"; IEEE Xplore; Mar. 25, 2009.

Das, D. K., and K. Kumar, "Chemical vapor deposition of boron on a beryllium surface," Thin Solid Films, 83(1), 53-60.

Das, K., and Kumar, K., "Tribological behavior of improved chemically vapor-deposited boron on beryllium," Thin Solid Films, 108(2), 181-188.

Gevin et al., "IDeF-X V1.0: performances of a new CMOS multi channel analogue readout ASIC for Cd(Zn)Te detectors", IDDD, Oct. 2005, 433-437, vol. 1.

Grybos et al., "DEDIX—development of fully integrated multichannel ASCI for high count rate digital x-ray imaging systems", IEEE, 693-696, vol. 2.

Grybos et al., "Measurements of matching and high count rate performance of mulitchannel ASIC for digital x-ray imaging systems", IEEE, Aug. 2007, 1207-1215, vol. 54, Issue 4.

Grybos et al., "Pole-Zero cancellation circuit with pulse pile-up tracking system for low noise charge-sensitive amplifiers", Feb. 2008, 583-590, vol. 55, Issue 1.

Hanigofsky, J. A., K. L. More, and W. J. Lackey, "Composition and microstructure of chemically vapor-deposited boron nitride, aluminum nitride, and boron nitride + aluminum nitride composites," J. Amer. Ceramic Soc. 74, 301 (1991).

http://www.orau.org/ptp/collectio/xraytubescollidge/MachlettCW250T.htm, 1999, 2 pages.

Komatsu, S., and Y. Moriyoshi, "Influence of atomic hydrogen on the growth reactions of amorphous boron films in a low-pressure B.sub.2 H.sub.6 +He+H.sub.2 plasma", J. Appl. Phys. 64, 1878 (1988).

Komatsu, S., and Y. Moriyoshi, "Transition from amorphous to crystal growth of boron films in plasma-enhanced chemical vapor deposition with B.sub.2 H.sub.6 +He," J. Appl. Phys., 66, 466 (1989).

(56) References Cited

OTHER PUBLICATIONS

Komatsu, S., and Y. Moriyoshi, "Transition from thermal-to electron-impact decomposition of diborane in plasma-enhanced chemical vapor deposition of boron films from B.sub.2 H.sub.6 +He," J. Appl. Phys. 66, 1180 (1989).
Lee, W., W. J. Lackey, and P. K. Agrawal, "Kinetic analysis of chemical vapor deposition of boron nitride," J. Amer. Ceramic Soc. 74, 2642 (1991).
Michaelidis, M., and R. Pollard, "Analysis of chemical vapor deposition of boron," J. Electrochem. Soc. 132, 1757 (1985).
Micro X-ray Tube Operation Manual, X-ray and Specialty Instruments Inc., 1996, 5 pages.
Moore, A. W., S. L. Strong, and G. L. Doll, "Properties and characterization of codeposited boron nitride and carbon materials," J. Appl. Phys. 65, 5109 (1989).
Nakamura, K., "Preparation and properties of amorphous boron nitride films by molecular flow chemical vapor deposition," J. Electrochem. Soc. 132, 1757 (1985).
Neyco, "SEM & TEM: Grids"; catalog; http://www.neyco.fr/pdf/Grids.pdf#page=1.
Panayiotatos, et al., "Mechanical performance and growth characteristics of boron nitride films with respect to their optical, compositional properties and density," Surface and Coatings Technology, 151-152 (2002) 155-159.
Perkins, F. K., R. A. Rosenberg, and L. Sunwoo, "Synchrotronradiation deposition of boron and boron carbide films from boranes and carboranes: decaborane," J. Appl. Phys. 69,4103 (1991).
Powell et al., "Metalized polyimide filters for x-ray astronomy and other applications," SPIE, pp. 432-440, vol. 3113.
Rankov et al., "A novel correlated double sampling poly-Si circuit for readout systems in large area x-ray sensors", IEEE, May 2005, 728-731, vol. 1.
Roca i Cabarrocas, P., S. Kumar, and B. Drevillon, "In situ study of the thermal decomposition of B.sub.2 H.sub.6 by combining spectroscopic ellipsometry and Kelvin probe measurements," J. Appl. Phys. 66, 3286 (1989).
Scholze et al., "Detection efficiency of energy-dispersive detectors with low-energy windows" X-Ray Spectrometry, X-Ray Spectrom, 2005: 34: 473-476.
Sheather, "The support of thin windows for x-ray proportional counters," Journal Phys,E., Apr. 1973, pp. 319-322, vol. 6, No. 4.
Shirai, K., S.-I. Gonda, and S. Gonda, "Characterization of hydrogenated amorphous boron films prepared by electron cyclotron resonance plasma chemical vapor deposition method," J. Appl. Phys. 67, 6286 (1990).
Tamura, et al "Developmenmt of ASICs for CdTe Pixel and Line Sensors", IEEE Transactions on Nuclear Science, vol. 52, No, 5, Oct. 2005.
Tien-Hui Lin et al., "An investigation on the films used as the windows of ultra-soft X-ray counters.".
Acta Physica Sinica, vol. 27, No. 3, pp. 276-283, May 1978, abstract only.
U.S. Appl. No. 13/307,579, filed Nov. 30, 2011; Dongbing Wang.
Vandenbulcke, L. G., "Theoretical and experimental studies on the chemical vapor deposition of boron carbide," Indust. Eng. Chem. Prod. Res. Dev. 24, 568 (1985).
Viitanen Veli-Pekka et al., Comparison of Ultrathin X-Ray Window Designs, presented at the Soft X-rays in the 21st Century Conference held in Provo, Utah Feb. 10-13, 1993, pp. 182-190.
Wagner et al, "Effects of Scatter in Dual-Energy Imaging: An Alternative Analysis"; IEEE; Sep. 1989, vol. 8. No. 3.
Winter, J., H. G. Esser, and H. Reimer, "Diborane-free boronization," Fusion Technol. 20, 225 (1991).
Wu, et al.; "Mechanical properties and thermo-gravimetric analysis of PBO thin films"; Advanced Materials Laboratory, Institute of Electro-Optical Engineering; Apr. 30, 2006.
www.moxtek,com, Moxtek, Sealed Proportional Counter X-Ray Windows, Oct. 2007, 3 pages.
www.moxtek.com, Moxtek, AP3 Windows, Ultra-thin Polymer X-Ray Windows, Sep. 2006, 2 pages.
www.moxtek.com, Moxtek, DuraBeryllium X-Ray Windows, May 2007, 2 pages.
www.moxtek.com, Moxtek, ProLine Series 10 Windows, Ultra-thin Polymer X-Ray Windows, Sep. 6, 2012.
www.moxtek.com, X-Ray Windows, ProLINE Series 20 Windows Ultra-thin Polymer X-ray Windows, 2 pages. Applicant believes that this product was offered for sale prior to the filed of applicant's application.
U.S. Appl. No. 12/890,325. filed Sep. 24, 2010; Dongbing Wang; office action dated Sep. 7, 2012.
PCT Application No. PCT/US2011/044168; filedMar. 28, 2012; Kang Hyun II; report mailed Mar. 28, 2012.

SMALL X-RAY TUBE WITH ELECTRON BEAM CONTROL OPTICS

BACKGROUND

A desirable characteristics of x-ray tubes for some applications, especially for portable x-ray sources, is small size. Due to very large voltages between a cathode and an anode of an x-ray tube, such as tens of kilovolts, it can be difficult to reduce x-ray tubes to a smaller size.

Another desirable characteristic of x-ray tubes is electron beam stability within the x-ray tube, including both positional stability and steady electron beam flux. A moving or wandering electron beam within the x-ray tube can result in instability or moving x-ray flux output. An unsteady electron beam flux can result in unsteady x-ray flux output.

Another desirable characteristic of x-ray tubes is a consistent and centered location where the electron beam hits the target, which can result in a more a consistent and centered location where x-rays hit a sample. Another desirable characteristic of x-ray tubes is efficient use of electrical power input to the x-ray source. Another desirable characteristic is high x-ray flux from a small x-ray source.

SUMMARY

It has been recognized that it would be advantageous to have an x-ray tube with small size, electron beam stability, consistent and centered location where the electron beam hits the target, efficient use of electrical power input to the x-ray source, and high x-ray flux. The present invention is directed to an x-ray tube that satisfies these needs.

The x-ray tube comprises an anode disposed at one end of an electrically insulative cylinder, the anode including a target which can be configured to emit x-rays in response to electrons impinging upon the target, and a cathode disposed at an opposing end of the insulative cylinder from the anode, the cathode including an electron emitter. The x-ray tube includes an operating range of 15 kilovolts to 40 kilovolts between the cathode and the anode. The x-ray tube includes an overall diameter, defined as a largest diameter of the x-ray tube anode, cathode, and insulative cylinder, of less than 0.6 inches. A direct line of sight exists between all points on the electron emitter to the target.

DEFINITIONS

Figure 1:
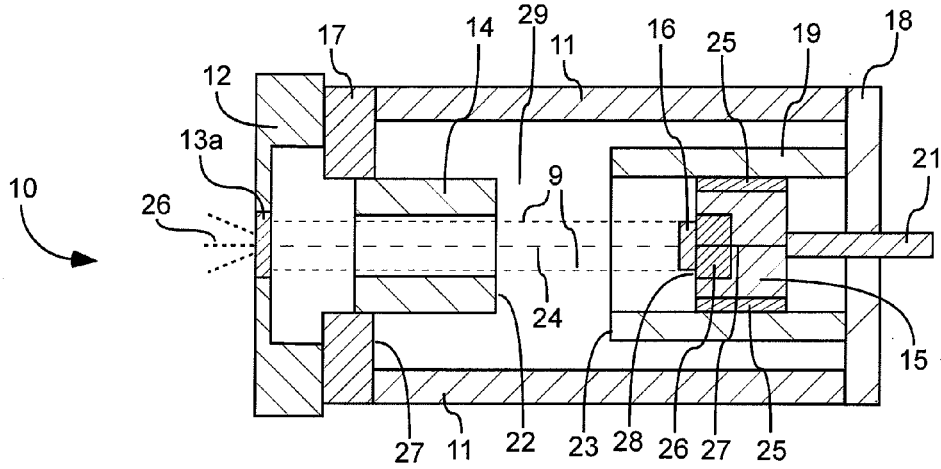
FIG. 1 is a schematic cross-sectional side view of an x-ray tube, with a transmission target, in accordance with an embodiment of the present invention.

As used herein, the term "direct line of sight" means no solid structures in a straight line between the objects. Specifically, no solid structures in a straight line between all points on the cathode electron emitter and the anode target, other than portions of the electron emitter and the anode target themselves.

As used herein, the term "mil" is a unit of length equal to 0.001 inches.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have about the same overall result as if absolute and total completion were obtained. The use of "substantially" is equally applicable when used in a negative connotation to refer to the complete or near complete lack of an action, characteristic, property, state, structure, item, or result.

DETAILED DESCRIPTION

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

As illustrated in FIGS. 1-5, x-ray tubes 10, 30, and 50 are shown comprising an anode 12 disposed at one end of an electrically insulative cylinder 11. The insulative cylinder 11 has a hollow central section 29. The anode 12 can include a target 13 which can be configured to emit x-rays 26 in response to electrons 24 impinging upon the target 13. A cathode 15 can be disposed at an opposing end of the insulative cylinder 11 from the anode 12, the cathode 15 can include an electron emitter 16.

Figure 2:
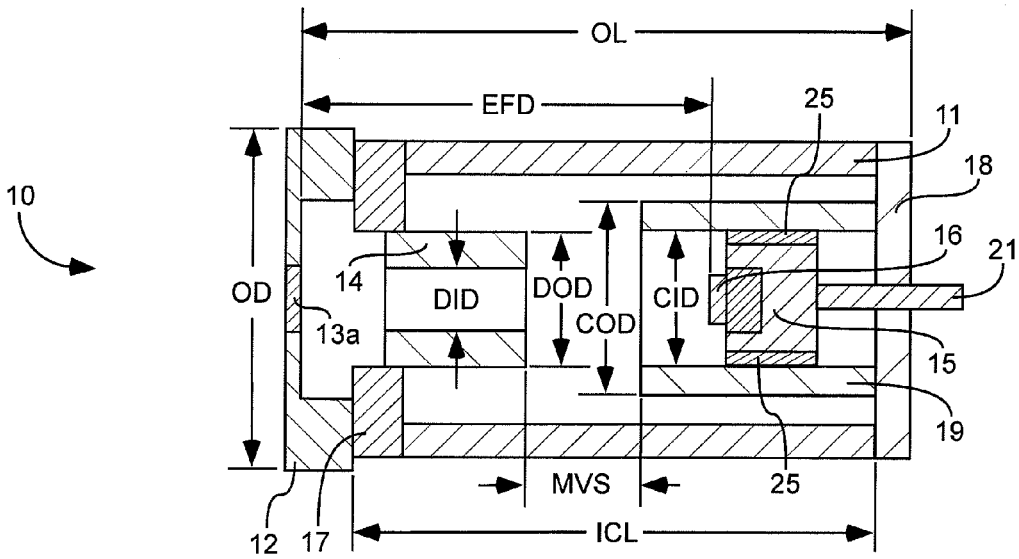
FIG. 2 is a schematic cross-sectional side view of an x-ray tube, with a transmission target, in accordance with an embodiment of the present invention.
Figure 3:
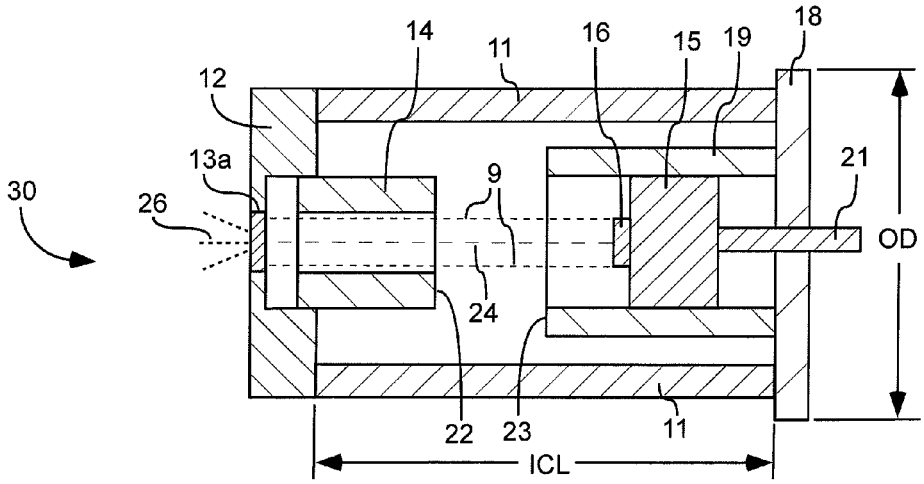
FIG. 3 is a schematic cross-sectional side view of an x-ray tube, with a transmission target, in accordance with an embodiment of the present invention.
Figure 5:
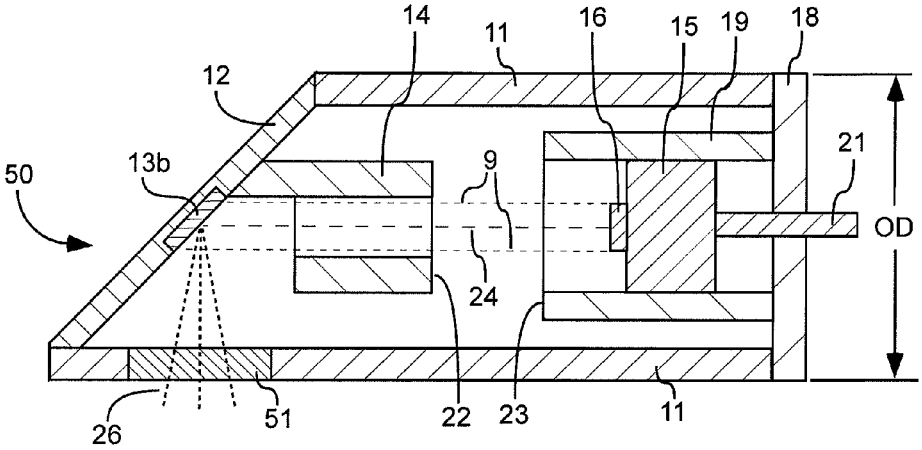
FIG. 5 is a schematic cross-sectional side view of an x-ray tube, with a reflection target, in accordance with an embodiment of the present invention

FIGS. 1-3 show x-ray tubes 10 and 30 that have transmission targets 13*a*. A transmission target 13*a* is a target that is configured for allowing electrons 24 from the electron emitter 16 to hit the target 13 on one side and allow x-rays 26 to exit the x-ray tube from the other side of the target. An x-ray tube 50 with a reflection target 13*b* and a side window 51 is shown in FIG. 5. With a reflection target 13*b*, electrons impinge upon one side of the target 13*b* and x-rays are emitted from this same side towards the x-ray window 51.

The electron emitter can be a filament. The term "electron emitter", unless specified otherwise, can include multiple electron emitters, thus the x-ray tube can include a single electron emitter, or can include multiple electron emitters.

As shown in FIG. 1, the x-ray tube 10 can include a primary optic 26, comprising a cavity in the cathode 15, having an open end 28 facing the electron emitter 16, and disposed on an opposite side of the electron emitter 16 from the anode 12. The x-ray tube 10 can include electrical connections 21 to be connected to a power source and electrical connector(s) 27 for the electron emitter 16. The electrical connectors 27 can include two wires for supplying alternating current to a filament electron emitter 16. In one embodiment, one of these two wires is electrically connected to the cathode 15 and the other is electrically insulated from the cathode 15. In another embodiment, the electrical connectors 27 are not electrically connected to the cathode 15, and the cathode 12 is maintained at a different voltage than the electron emitter 16. A decision of whether to electrically connect the electron emitter 16 to the cathode 15 may be made based on desired effect on the electron beam 24.

Figure 4A:
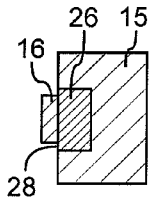
FIGS. 4*a-c* are schematic cross-sectional side views of x-ray tube cathodes with primary optics, and electron emitters, in accordance with embodiments of the present invention.
Figure 4B:
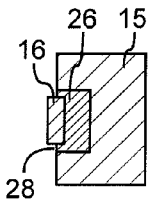
Figure 4C:
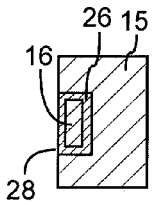

Various embodiments of the cathode 15, the primary optic 26, and the electron emitter 16 are shown in FIGS. 4*a-c*. In FIG. 4*a*, the electron emitter 16 is disposed fully outside of the primary optic 26 cavity. In FIG. 4*b*, the electron emitter 16 is disposed partially inside of the primary optic 26 cavity. In FIG. 4*c*, the electron emitter 16 is disposed fully inside the primary optic 26 cavity. A decision of placement of the electron emitter 16 with respect to the primary optic 26 may be made based on desired effect of the primary optic on the electron beam 24.

A cylindrical, electrically conductive electron optic divergent lens 14 can be attached to the anode 12 and can have a far end 22 extending from the anode 12 towards the cathode 15. The cylindrical shape of the divergent lens 14 can be an annular, hollow shape, to allow electrons to pass through a central section of the divergent lens 14 from the electron emitter 16 to the target 13.

In the present invention, the entire divergent lens 14 can be made of electrically conductive material in one embodiment, or only the surface, or a substantial portion of the surface, of the divergent lens 14 can be made of electrically conductive material in another embodiment. Thus, the term "electrically conductive electron optic divergent lens" does not necessarily mean that the entire structure is electrically conductive, only that enough of the divergent lens 14 is electrically conductive to allow this structure to act as an electron optic lens.

The divergent lens 14 can be attached directly to, and thus electrically connected to, the anode 12. Alternatively, an electrically insulative connector or spacer 17 can separate the anode 12 from the divergent lens 14, thus electrically insulating the divergent lens 14 from the anode 12. In one embodiment, in which an electrically insulative connector or spacer 17 is used, the divergent lens 14 can be maintained at a voltage that is intermediate between a voltage of the cathode 15 and a voltage of the anode 12.

If spacer 17 is used, a separate structure can be used to provide voltage to the divergent lens 14, or a portion of the surface 27 of the spacer can be electrically conductive, such as with a metal coating on this portion of the surface 27, to allow transfer of a voltage to the divergent lens 14.

A cylindrical, electrically conductive electron optic convergent lens 19 can be attached to and can surround the cathode 15 and can have a far end 23 extending from the cathode 15 towards the anode 12. The cylindrical shape of the convergent lens 19 can be an annular, hollow shape, to allow electrons to pass from the electron emitter 16 through a central section of the convergent lens 19 to the target 13.

The entire convergent lens 19 can be made of electrically conductive material in one embodiment, or only the surface, or a substantial portion of the surface, of the convergent lens 19 can be made of electrically conductive material in another embodiment. Thus, the term "electrically conductive electron optic convergent lens" does not necessarily mean that the entire structure is electrically conductive, only that enough of the convergent lens is electrically conductive to allow this structure to act as an electron optic lens.

The convergent lens 19 can be attached directly to, and thus electrically connected to, the cathode 15 in one embodiment. The convergent lens 19 can be attached to the cathode 15 through an electrically insulative connector or spacer 25, and thus the convergent lens 19 can be electrically insulated from the cathode 15, in another embodiment. In one embodiment, in which an electrically insulative connector or spacer 25 is used, the convergent lens 19 can by maintained at a voltage that is intermediate between a voltage of the cathode 15 and a voltage of the anode 12.

It can be desirable in some situations for electron beam and target spot shape control to have the convergent lens 19 electrically insulated from the cathode 15 and/or have the divergent lens 14 electrically insulated from the anode 12, and a separate electrical connection made to the convergent lens 19 and/or divergent lens 14. It can be desirable in other situations, for simplification of power supply and/or tube construction, to have the divergent lens 14 electrically connected to the anode 12 and/or the convergent lens 19 to be electrically connected to the cathode 15.

Electron flight distance EFD, defined as a distance from the electron emitter 16 to the target 13, can be an indication of overall tube size. It can be desirable in some circumstances, especially for miniature, portable x-ray tubes, to have a short electron flight distance EFD. The electron flight distance EFD can be less than 0.8 inches in one embodiment, less than 0.7 inches in another embodiment, less than 0.6 inches in another embodiment, less than 0.4 inches in another embodiment, or less than 0.2 inches in another embodiment.

The tube overall diameter OD is defined as a largest diameter of the x-ray tube anode 12, cathode 15, or insulative cylinder 11, measured perpendicular to the line of sight 9 between the electron emitter 16 and the target 13. Any structure electrically connected to the cathode 15, and thus having substantially the same voltage as the cathode 15, will be considered part of the cathode 15 for determining the cathode diameter. If, in FIG. 3, the cathode 15 is electrically connected to tube end cap 18, then the end cap 18 will be considered part of the cathode 15 for determining cathode diameter, and the cathode diameter will be the tube end cap 18 diameter which will also be the overall diameter OD. The x-ray tube overall diameter is less than 0.7 inches in one embodiment, less than 0.6 inches in another embodiment, or less than 0.5 inches in another embodiment.

In one embodiment, a direct line of sight 9 can exist between all points on the electron emitter 16 and the target 13. The direct line of sight 9 can extend between all points on the electron emitter 16 through a central portion of the convergent lens 19, through a central portion of the divergent lens 14, to the target 13. This direct line of sight 9 can be beneficial for improved use of electrons and thus improved power efficiency (more power output compared to power input).

A relationship between the electron flight distance EFD and the overall diameter OD can be important for small tube design with optimal performance, such as small tube size with good electron beam control and stability. In the present invention, electron flight distance EFD divided by an overall diameter OD is greater than the 1.0 and less than 1.5 in one embodiment, the electron flight distance EFD divided by an overall diameter OD is greater than the 1.1 and less than 1.4 in another embodiment, the electron flight distance EFD divided by an overall diameter OD is greater than the 1.2 and less than 1.3 in another embodiment.

A maximum voltage standoff length MVS is defined as a distance from the far end 22 of the divergent lens 14 to the far end 23 of the convergent lens 19. The maximum voltage standoff length MVS can indicate electron acceleration distance within the tube. Electron acceleration distance can be an important dimension for electron spot centering on the target (location where electrons primarily impinge upon the target). In the present invention, the maximum voltage standoff length MVS is less than 0.15 inches in one embodiment, less than 0.25 inches in another embodiment, or less than 0.35 inches in another embodiment.

The relationship between an inside diameter CID of the convergent lens 19 and an outside diameter DOD of the divergent lens 14 can be important for electron beam shaping. In one embodiment, the inside diameter CID of the convergent lens 19 is greater than 0.85 times the outside diameter of the divergent lens DOD (CID>0.85*DOD). In another embodiment, the inside diameter CID of the convergent lens 19 is greater than 0.95 times the outside diameter of the divergent lens DOD (CID>0.95*DOD). In another embodiment, the inside diameter CID of the convergent lens 19 is greater than the outside diameter of the divergent lens DOD (CID>DOD). In another embodiment, the inside diameter CID of the convergent lens 19 is greater than 1.1 times the outside diameter of the divergent lens DOD (CID>1.1*DOD).

The actual electrical field gradient can vary through the tube, but for purposes of claim definition, electrical field gradient is defined by the tube voltage between the cathode and the anode, divided by the maximum voltage standoff length MVS. A tube that can withstand higher electrical field gradients is a tube that can withstand very large voltages relative to the small size of the tube, and can function properly without breakdown. In the present invention, the electrical field gradient can be greater than 200 volts per mil in one embodiment, greater than 250 volts per mil in another embodiment, greater than 300 volts per mil in another embodiment, greater than 400 volts per mil in another embodiment, greater than 500 volts per mil in another embodiment, or greater than 600 volts per mil in another embodiment.

A relationship between an outside diameter COD of the convergent lens 19 and the maximum voltage standoff length MVS can be important for a consistent, centered electron spot on the target and for small tube size. In one embodiment, an outside diameter COD of the convergent lens 19 divided by the maximum voltage standoff length MVS is greater than 1 and less than 2.

Insulative cylinder length ICL is defined as a distance from closest contact of the insulative cylinder 11 with the cathode 15, or other electrically conductive structure electrically connected to the cathode 15, to closest contact with the anode 14, or other electrically conductive structure electrically connected to the anode 14. Insulative cylinder length ICL is a distance along a surface of the insulative cylinder 11. Insulative cylinder length ICL can be based on a straight line if the insulative cylinder 11 has a straight structure between cathode and anode or can be based on a curved or bent line if the insulative cylinder, and other insulating structures if used, have bends or curves. Insulative cylinder length ICL is thus an indication of distance of insulative material required to electrically insulate the anode 12 from the cathode 15. FIGS. 2 & 3 show insulative cylinder length ICL. In both figures, it is assumed for purposes of defining insulative cylinder length ICL that the tube end cap 18 is electrically conductive and is electrically connected to the cathode 15.

It can be beneficial, for reduction of tube size, to have a small insulative cylinder length ICL. In the present invention, the insulative cylinder length can be less than 1 inch in one embodiment, less than 0.85 inches in another embodiment, less than 0.7 inches in another embodiment, or less than 0.55 inches in another embodiment.

It can be beneficial for some applications, such as portable x-ray tubes, to have a small tube. Tube overall length OL is defined as x-ray tube length from a far end of the cathode to a far end of the anode.

A relationship between the overall length OL and overall diameter OD can be important for tube size and optimal electron beam control. In the present invention, the overall length OL divided by an overall diameter OD can be greater than 1.7 and less than 2.5 in one embodiment, greater than 1.9 and less than 2.3 in another embodiment, or greater than 2.0 and less than 2.2 in another embodiment.

A relationship between the outside diameter DOD of the divergent lens 14 divided by an inside diameter DID of the divergent lens 14 can be important for electron beam control. In the present invention, an outside diameter DOD of the divergent lens 14 divided by an inside diameter DID of the divergent lens 14 can be greater than 1.6 and less than 3.4 in one embodiment, greater than 1.9 and less than 3.0 in another embodiment, or greater than 2.1 and less than 2.5 in another embodiment.

A benefit of the present invention is the ability for a small x-ray tube to be operated at high voltages between the cathode and the anode. The tubes 10, 30, and 50 of the present invention can comprise or include an operating range of 15 kilovolts to 40 kilovolts in one embodiment, an operating range of 50 kilovolts to 80 kilovolts in another embodiment, or an operating range of 15 kilovolts to 60 kilovolts in another embodiment. An x-ray tube that includes a certain voltage operating range means that the x-ray tube is configured to operate effectively at all voltages within that range. For example, the term "an operating range of 15 kilovolts to 40 kilovolts" is used herein to refer to a tube with an operating range effectively at all voltages within 15 to 40 kilovolts, including by way of example, an operating range of 14 to 41 kilovolts.

The various embodiments described herein can have high electron transport efficiency. Electron transport efficiency (ETE) is defined as a percent of electrons absorbed by the target $E_t$ divided by electrons emitted from the electron emitter $$E_e\left(ETE = \frac{E_t}{E_e}\right).$$

The percent or electrons absorbed by the target $E_t$ can be the percent absorbed within a certain area, such as within a specified radius of a center of the target or within a specified diameter spot size anywhere on the target 13. In one embodiment, 90% of electrons emitted by the electron emitter are absorbed within a 0.75 millimeter radius of a center of the target. In another embodiment, 90% of electrons emitted by the electron emitter are absorbed within a 0.4 millimeter radius of a center of the target. In another embodiment, 90% of electrons emitted by the electron emitter are absorbed within a 0.3 millimeter diameter of a spot on the target (anywhere on the target).

The previously described x-ray tubes 10 and 30 can have many advantages, including small size, electron beam stability, consistent and centered location where the electron beam hits the target, and efficient use of electrical power input to the x-ray source, and high voltage between anode and cathode. Many of these advantages are achieved, not by a single factor alone, but by a combination of factors or tube dimensions. Thus, the present invention is directed to an x-ray tube that combines various size relationships and structures to provide improved x-ray tube performance.

For example, one x-ray tube design that has provided the benefits just mentioned, has the following approximate dimensions:

Convergent lens inside diameter CID=0.18 inches
Convergent lens outside diameter COD=0.30 inches
Divergent lens inside diameter DID=0.08 inches
Divergent lens outside diameter DOD=0.18 inches
Electron flight distance EFD=0.66 inches
Insulative cylinder length ICL=0.62 inches
Maximum voltage standoff MVS=0.20 inches
Overall diameter OD=0.52 inches
Overall length OL=1.1 inches This x-ray tube was designed to include an operating range of 10 kilovolts to 40 kilovolts between the cathode 15 and the anode 12. The anode 12 of this tube is electrically connected to the divergent lens 14 and the cathode 15 is electrically connected to the convergent lens 19.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. An x-ray tube, comprising:
a. an electrically insulative cylinder;
b. an anode disposed at one end of the insulative cylinder, the anode including a target which is configured to emit x-rays in response to electrons impinging upon the target;
c. a cathode disposed at an opposing end of the insulative cylinder from the anode, the cathode including an electron emitter;
d. a primary optic, comprising a cavity in the cathode, having an open end facing the electron emitter, and disposed on an opposite side of the electron emitter from the anode;
e. an operating range of 15 kilovolts to 40 kilovolts between the cathode and the anode;
f. an overall diameter, defined as a largest diameter of the x-ray tube anode, cathode, and insulative cylinder, being less than 0.6 inches;
g. a cylindrical, electrically conductive electron optic divergent lens, attached to the anode and electrically connected to the anode, and having a far end extending from the anode towards the cathode;
h. a cylindrical, electrically conductive electron optic convergent lens, attached to and surrounding the cathode and electrically connected to the cathode, and having a far end extending from the cathode towards the anode;
i. an electron flight distance, from the electron emitter to the target, of less than 0.8 inches;
j. a maximum voltage standoff length, from the far end of the divergent lens to the far end of the convergent lens, being less than 0.25 inches;
k. an insulative cylinder length from closest contact with the cathode to closest contact with the anode being less than 0.7 inches; and
l. a direct line of sight between all points on the electron emitter through a central portion of the convergent lens, through a central portion of the divergent lens, to the target.

2. The x-ray tube of claim 1, wherein an inside diameter of the convergent lens is greater than 0.95 times an outside diameter of the divergent lens.

3. The x-ray tube of claim 1, wherein the electron flight distance, from the electron emitter to the target, is less than 0.7 inches.

4. The x-ray tube of claim 1, wherein the electron flight distance divided by the overall diameter is greater than 1.1 and less than 1.4.

5. The x-ray tube of claim 1, wherein an outside diameter of the convergent lens divided by the maximum voltage standoff length is greater than 1 and less than 2.

6. The x-ray tube of claim 1, wherein the target is a transmission target.

7. The x-ray tube of claim 1, wherein an overall length, of the x-ray tube from a far end of the cathode to a far end of the anode, is less than 1.1 inches.

8. The x-ray tube of claim 1, wherein the operating range is from 15 kilovolts to 60 kilovolts.

9. The x-ray tube of claim 1, wherein an outside diameter of the divergent lens divided by an inside diameter of the divergent lens is greater than 1.9 and less than 3.0.

10. An x-ray tube, comprising:
a. an electrically insulative cylinder;
b. an anode disposed at one end of the insulative cylinder, the anode including a target which is configured to emit x-rays in response to electrons impinging upon the target;
c. a cathode disposed at an opposing end of the insulative cylinder from the anode, the cathode including an electron emitter;
d. a primary optic, comprising a cavity in the cathode, having an open end facing the electron emitter, and disposed on an opposite side of the electron emitter from the anode;
e. an operating range of 15 kilovolts to 40 kilovolts between the cathode and the anode;
f. an overall diameter, defined as a largest diameter of the x-ray tube anode, cathode, and insulative cylinder, being less than 0.6 inches;
g. a cylindrical, electrically conductive electron optic convergent lens, attached to and surrounding the cathode and electrically connected to the cathode, and having a far end extending from the cathode towards the anode;
h. an electron flight distance, from the electron emitter to the target, of less than 0.7 inches;
i. a maximum voltage standoff length, from the far end of the divergent lens to the far end of the convergent lens, being less than 0.25 inches;
j. a direct line of sight between all points on the electron emitter through a central portion of the convergent lens to the target; and
k. wherein 90% of electrons emitted by the electron emitter are absorbed within a 0.75 millimeter radius of a center of the target.

11. The x-ray tube of claim 10, wherein the target is a transmission target.

12. The x-ray tube of claim 10, wherein the operating range is from 15 kilovolts to 60 kilovolts.

13. The x-ray tube of claim 10, wherein 90% of electrons emitted by the electron emitter are absorbed within a 0.4 millimeter radius of a center of the target.

14. The x-ray tube of claim 10, wherein 90% of electrons emitted by the electron emitter are absorbed within a 0.3 millimeter diameter spot on the target.

15. An x-ray tube, comprising:
a. an electrically insulative cylinder;

b. an anode disposed at one end of the insulative cylinder, the anode including a target which is configured to emit x-rays in response to electrons impinging upon the target;

c. a cathode disposed at an opposing end of the insulative cylinder from the anode, the cathode including an electron emitter;

d. an operating range of 15 kilovolts to 40 kilovolts between the cathode and the anode;

e. an insulative cylinder length from closest contact with the cathode to closest contact with the anode being less than 0.7 inches;

f. an overall diameter, defined as a largest diameter of the x-ray tube anode, cathode, and insulative cylinder, being less than 0.6 inches;

g. a direct line of sight between all points on the electron emitter to the target; and h. wherein 90% of electrons emitted by the electron emitter are absorbed within a 0.75 millimeter radius of a center of the target.

16. The x-ray tube of claim 15, wherein the target is a transmission target.

17. The x-ray tube of claim 15, wherein the operating range is from 15 kilovolts to 60 kilovolts.

18. The x-ray tube of claim 15, wherein 90% of electrons emitted by the electron emitter are absorbed within a 0.4 millimeter radius of a center of the target.

19. The x-ray tube of claim 15, wherein 90% of electrons emitted by the electron emitter are absorbed within a 0.3 millimeter diameter spot on the target.

20. The x-ray tube of claim 15, wherein the x-ray tube has an electron flight distance, from the electron emitter to the target, of less than 0.7 inches.

* * * * *